US005236195A

United States Patent [19]

Rovnyak, Sr.

[11] Patent Number: 5,236,195

[45] Date of Patent: Aug. 17, 1993

[54] PADDLE AND PROJECTILE KIT AND GAME

[76] Inventor: Richard M. Rovnyak, Sr., 433 S. Salem Dr., Schaumburg, Ill. 60193

[21] Appl. No.: 867,175

[22] Filed: Apr. 10, 1992

[51] Int. Cl.[5] ..... A63B 67/00; A63B 59/00

[52] U.S. Cl. ..... 273/341; 273/67 R; 273/428

[58] Field of Search ..... 273/341, 67 R, 67 DC, 273/428

[56] References Cited

U.S. PATENT DOCUMENTS

| | | | |
|---|---|---|---|
| 229,791 | 7/1880 | Wunderlich | 273/341 |
| 670,487 | 3/1901 | Wagner | 273/341 |
| 672,478 | 4/1901 | Gedney | 273/341 |
| 753,029 | 2/1904 | Astarita | 273/341 |
| 1,387,946 | 8/1921 | Rutherford et al. | 273/341 |
| 3,091,461 | 5/1963 | Taylor | 273/341 |
| 3,957,270 | 5/1976 | Fekete | 273/341 |
| 4,093,226 | 6/1978 | Priestle | 273/341 |
| 4,149,724 | 4/1979 | Walsh | 273/341 |
| 4,183,532 | 1/1980 | Iglesias et al. | 273/341 |
| 4,239,232 | 12/1980 | Durham, Sr. | 273/341 |

FOREIGN PATENT DOCUMENTS

| | | |
|---|---|---|
| 337047 | 11/1921 | Fed. Rep. of Germany . |
| 1377345 | 2/1985 | France . |

*Primary Examiner*—William H. Grieb

*Attorney, Agent, or Firm*—Thomas R. Vigil

[57] ABSTRACT

A paddle and projectile kit and method, comprising in combination: a paddle including a face and handle for holding the paddle; and a projectile having a generally rectangular cross-section including at least one projection extending outwardly therefrom.

13 Claims, 2 Drawing Sheets

PADDLE AND PROJECTILE KIT AND GAME

BACKGROUND OF THE INVENTION

1. Field of the Invention

The present invention relates to a novel paddle and projectile kit and to game involving a projectile and paddle, for driving the projectile to a desired area.

2. Description of the Related Art Including Information Disclosed Under 37 USC §1.97–99

Over the years a number of bat or paddle and projectile or ball games have been proposed. Typifying these games, are those disclosed in U.S. Pat. Nos. 4,183,532, 4,149,724 and 3,091,461, and German Patent No. 337047 and French Patent No. 1,377,345.

U.S. Pat. No. 4,183,532 discloses a flipper game which requires a bat, an elongated cylindrical flipper and a stand. The flipper is batted twice, first to flip it up into the air from the holder and secondly, to impart a transitional movement. The adverse player tries to catch the flipper with a stopper which resembles a stringless racket-ball racquet with a net.

U.S. Pat. No. 4,149,724 discloses a bat and stick game, which requires a contoured stand to elevate the stick or baton above the ground.

U.S. Pat. No. 3,091,461 discloses a game which requires a flat target, game station discs, bats and projectiles having elongated rectangular cross section bodies with conical ends adapted to be laid upon and driven from the station to the target.

German Patent No. 337,047 discloses prism shaped projectiles and an oddly shaped bat.

French Patent No. 1,377,345 discloses different shapes of projectiles and sticks.

SUMMARY OF THE INVENTION

According to the present invention there is provided a paddle and projectile kit, comprising in combination, a paddle having a longitudinal axis and including a middle portion with a front face and a back face and handle means for holding said paddle; and a projectile having a longitudinal axis, a generally rectangular cross-section in the direction of the longitudinal axis and at least one generally flat end surface traversing the longitudinal axis and including at least one rod like, non-tapered projection extending generally perpendicularly outwardly from a middle portion of said at least one generally flat end surface sufficiently enough to provide a long enough target for the paddle to strike easily while not extending too far perpendicularly outwardly to interfere with a desired pop up action of the projectile when it is hit with the paddle and extending a distance which is less than the lateral or transverse extent of the cross-section or envelope of the projectile.

Further according to the present invention there is provided a paddle and projectile kit, comprising in combination: a paddle including a face and handle means for holding said paddle, the face including a middle portion and an end portion opposite the handle means and the end portion having a special configuration, and a projectile having a generally rectangular cross-section including at least one projection extending outwardly therefrom.

Still further according to the present invention there is provided a method of playing a paddle and projectile game comprising the steps of:

a) determining the order of play and at least two players, #1 and #2, proceeding to play the game by alternating turns in sequence;

b) player #1 swinging a paddle in a downwardly direction in proximity to a home base and striking a projectile having at least one projection extending outwardly therefrom in proximity to said projection such that said projectile moves in a substantially upwardly direction sufficiently high enough in the air in order that it can be struck again;

c) player #1 swinging said paddle in a generally horizontal direction and restriking said projectile in a substantially horizontal direction away from home base into a playing field;

d) player #1 challenging player #2 by predicting how many steps it will take player #2 to get from said home base to said projectile with a second projectile;

e) player #2 accepting player #1's challenge by attempting to make it from said home base to said projectile in the number of steps or less predicted by player #1 or player #2 declining player #1's challenge in step d;

f) awarding points to player #2 if successful at meeting player #1's challenge or awarding points to player #1 for player #2 failing to meet player #1's challenge or declining player #1's challenge; and g) alternating turns up to a fixed number of turns or points, the player with the most points winning.

Further according to the present invention there is provided a method of playing a paddle and projectile game comprising the steps of:

a) determining the order of play and at least two players, #1 and #2, proceeding by playing alternating turns in sequence;

b) player #1 striking in rapid succession a plurality of projectiles having at least one projection extending outwardly therefrom in proximity to said projection in a downwardly direction with a paddle in rapid succession, thereby flipping said projectiles upwardly;

c) player #2 attempting to catch as many projectiles while in flight as possible and awarding player #2 a point for each projectile caught; and d) alternating turns in steps b and c up to a fixed number of points or turns, the player with the most points winning.

Still further according to the present invention there is provided a method of playing a paddle and projectile game comprising the steps of:

a) player #1 striking a plurality of projectiles in a downwardly direction, thereby deflecting the projectiles in a generally horizontal direction toward player #2's targets, attempting to knock them down;

b) player #2 striking a plurality of projectiles in a downwardly direction, thereby deflecting the projectiles in a generally horizontal direction toward player #1's targets, attempting to knock them down; and c) awarding points for each target being knocked down, the player with the most points wins.

It is a desirable feature of the invention to provide a game kit and game, as indicated above, which affords a high degree of player interest and competition, and if desired, favors the development of skill.

A further desirable feature of the invention is to provide a portable, durable and simple to construct, paddle and projectile kit.

Another desirable feature of the invention is to provide an inexpensive game kit which can be utilized for a variety of games.

Another desirable feature of the invention is to allow playing of the game on many surfaces and areas in a substantially non-inhibiting way so as to utilize available conditions or adapt to the desires, interest, or physical ability of the players.

DESCRIPTION OF THE PREFERRED EMBODIMENT(S)

While this invention is susceptible of embodiments in many forms, there are shown in FIGS. 1–7 various embodiments suitable for use in the practice of this invention, with the understanding that the present disclosure is not intended to limit the invention to the embodiments illustrated.

Figure 1:
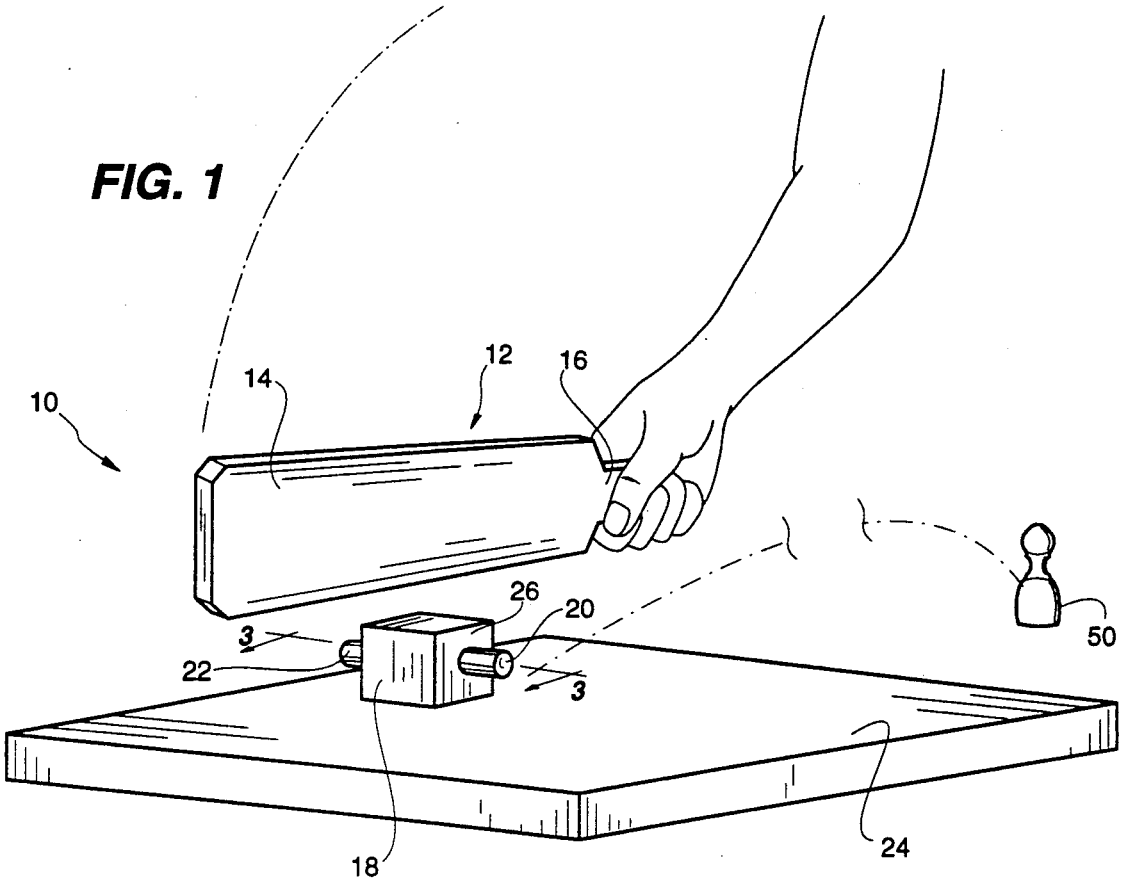
FIG. 1 is a perspective view of a person striking a projectile on a surface with a paddle.

Referring to FIG. 1, there is illustrated therein a paddle and projectile kit 10. The paddle and projectile kit 10 includes, in combination, a paddle 12 having a face 14 and a handle 16 for holding the paddle, and a projectile 18 having a generally rectangular cross-section including at least one projection 20 extending outwardly from a side thereof. The paddle and projectile kit 10 can include a planar surface or home plate 24 as a starting point or home base.

Figure 2:
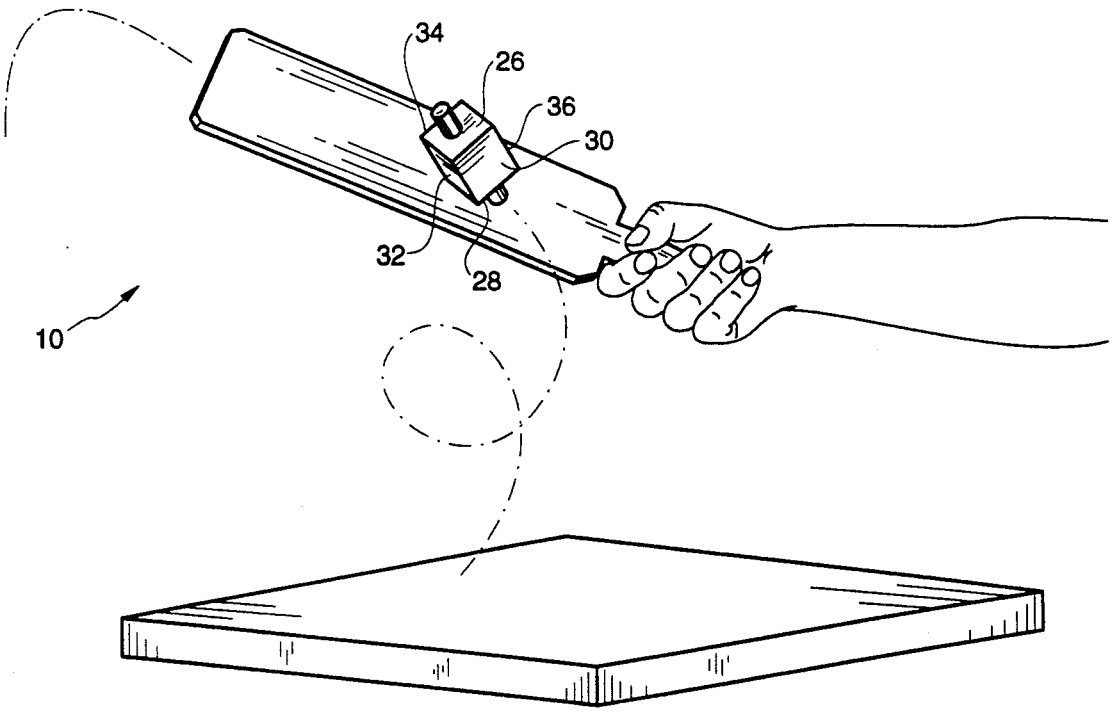
FIG. 2 is a perspective view of a person striking a projectile after it has been popped up in the air.

Referring to FIGS. 1 and 2, in one embodiment, the projectile 18 includes six sides, namely first side 26, second side 28, third side 30, fourth side 32, fifth side 34 and sixth side 36. The projectile 18 can be weighted to make it fly in an enhanced or unpredictable manner, can be hollow, or can have holes in it, like a whiffle projectile if desired.

Figure 3:
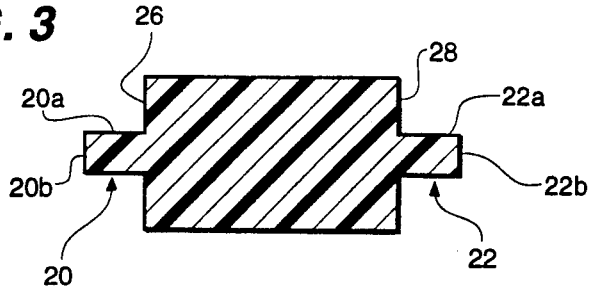
FIG. 3 is a cross-sectional view of the projectile shown in FIG. 1 and is taken along line 3—3 of FIG. 1.

Referring to FIG. 3, the projection 20 has a side surface 20*a* and an end surface 20*b*. A second projection 22 can be provided also having a side surface 22*a* and an end surface 22*b*. The first and second projections 20 and 22 extend outwardly and perpendicularly from opposite first and second sides 26 and 28, respectively, of the projectile 18. The first and second projections 20 and 22 have side surfaces 20*a* and 22*a* which extend laterally outwardly sufficiently enough to provide a wide or long target for the paddle 12 to strike easily, while not extending too far laterally to interfere with the desired pop up action and, as shown in FIG. 3, a distance which is less than the lateral or transverse extent of the projectile 18.

It should be understood by those skilled in the art, that the projections 20 and 22, can include any geometric shape such as tubular, square, polygonal, etc. Preferably, projections 20 and 22 are cylindrical, for ease of manufacture. First and second projections 20 and 22 extend from the middle of each side 26 and 28 for improved upwardly flipping or jumping or bouncing action when struck by a paddle 12.

Figure 4:
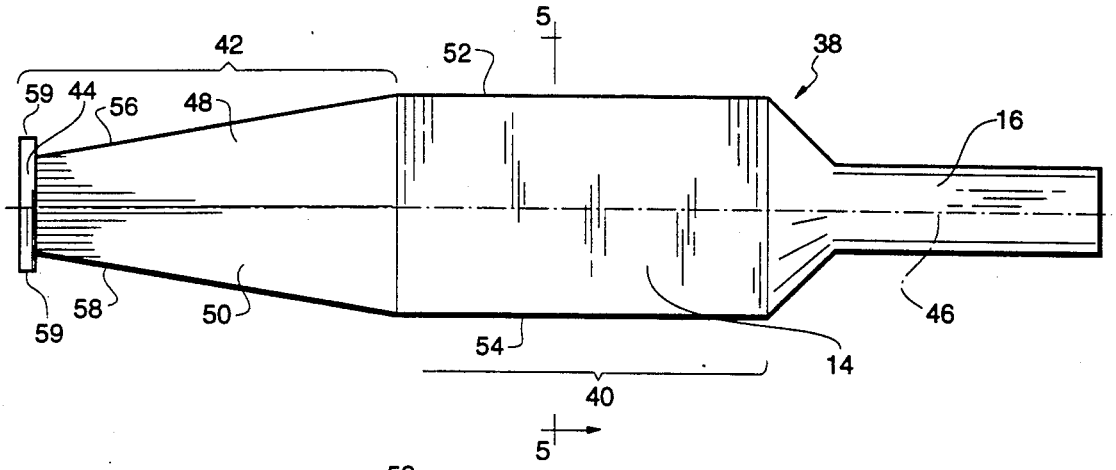
FIG. 4 is a side plan view of the paddle of FIG. 1.

FIG. 4 illustrates one preferred paddle 38, which includes a face 14 and a handle 16, the face further includes a middle portion 40 and end portion 42 opposite the handle 16, the end portion 42 being specially configured, namely tapered, as shown to a spacer member 44 at the outer end of the paddle 12. The handle 16 can include a strap for an improved grip.

Illustrated in phantom in FIG. 4 is an elongate axis 46, along the middle and across the length of paddle 12. The end portion 42 includes first and second tapered edges 56 and 58, respectively, extending toward each other and away from the handle 16 to narrow the end portion 42 to facilitate striking a target, such as projections 20 and 22 sidewalls 20*a* and 22*a* of the projectile 18.

The paddle 12 or 38 and projectile 18 can be made of any material such as plastic, wood, aluminum, etc., preferably plastic for its cost, weight and ease of manufacturing.

One preferred paddle 12 or 38 and projectile 18 can include a layer of soft material such as neoprene for enhanced softness.

Figure 5:
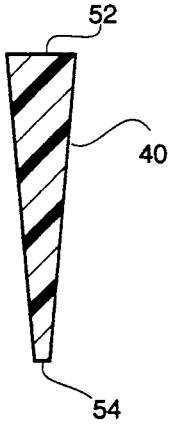
FIG. 5 is a cross-sectional view of the paddle shown in FIG. 4 and is taken along line 5—5 of FIG. 4.

FIG. 5 is a cross-sectional view of the middle portion 40 of the paddle 38. The middle portion 40 tapers from wide to narrow between a first wide edge 52 and a second narrower edge 54. The middle portion 40 is configured and designed this way so that when the projection 20 or 22 of projectile 18 is struck with the narrow edge 54, the projectile 18 is deflected horizontally (as it bumps into the side of the paddle) away from the paddle 38 and when the projection 20 or 22 is hit with the edge 56 or 58 adjacent the spacer member 44, the projectile 18 is caused to go generally vertically upwardly. The trajectory of the projectile is thereby controlled by the twist of the middle section 40 of the paddle 38 or the position along end portion 42.

Referring to FIG. 4, the end portion 42 is tapered, so that when the projectile 18 is struck downwardly in proximity to first or second projection 20 or 22, the projectile 18 tends to flip or jump up generally upwardly in a vertical direction. The paddle 38 further includes an axial axis 46 running axially therethrough. In one preferred embodiment, the end portion 42 includes first and second tapered sections 48 and 50. The width of the paddle 38 varies from wide to narrow from axis 46 to edges 56 and 58 in first and second sections 48 and 50, respectively, for improved striking action of the projections. The spacer member 44 is configured to limit the distance the paddle 12 can go downwardly toward surface 24, i.e. by having an edge 59 that extends beyond the edges 56 and 58, thereby causing an abrupt stop of downward force impulse on projectile 18 when struck on projection 20 or 22 causing the momentum of upward direction to be substantially vertical, resulting in increased popping up action. In addition, the projections 20 and 22 are configured in the middle of sides 26 and 28 and perpendicular thereto for enhanced popping-up or bouncing action. The projectile 18 tends to fly in a substantially vertical direction because the projection 20 or 22 is pushed toward the surface 24 it is lying on, causing the projectile 18 to pop upwardly in a vertical direction. The impulse force from the paddle 12 or 38 is stopped short of the surface 24 thereby allowing the opposite end with its accelerated momentum due to the leverage action to have an enhanced vertical velocity vector thereby bouncing substantially upwardly therefrom. The vertical jump component of the projectile 18 is improved because the end spacer member 44 prevents the edges 56 or 58 from contacting the flat surface 24 simultaneously while being stuck downwardly, resulting in an improved vertical jumping component of the projectile 18.

Referring to FIG. 4, the end portion 42 face is designed such that it is wider by the end nearer to the middle portion 40 and gradually narrows to the spacer member 44, so as to minimize the possibility that the projectile 18 will hit the face section 14 while traveling in an upwardly direction. The middle portion 40 provides a tapered, wide flat section for two purposes: 1) for hitting a projectile squarely, for example, in a horizontal direction for maximum distance while playing flit, and 2) for causing the projectile to deflect as it begins its ascent in its end over end motion in a substantially horizontal trajectory, for example ween playing a cannonball game, as described hereafter.

Figure 6:
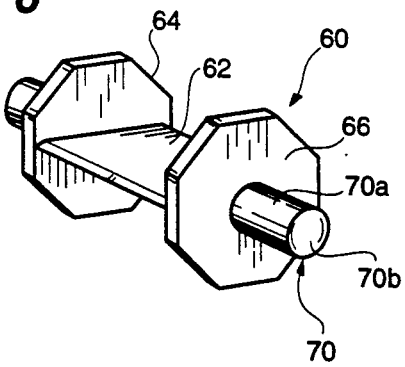
FIG. 6 is a perspective view of another embodiment of a projectile.
Figure 7:
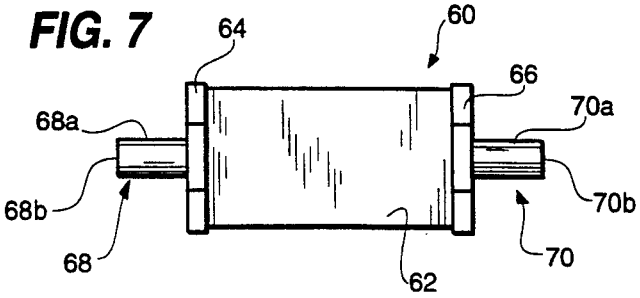
FIG. 7 is a top plan view of the projectile shown in FIG. 6.

Illustrated in FIGS. 6 and 7, is one preferred aerodynamic projectile 60. The projectile 60 includes a substantially flat wing section 62 in the middle fixed to two end flanges 64 and 66, each flange being sandwiched between the wing section 62 and projections 68 and 70, respectively.

The projections 68 and 70 include side walls 68*a* and 70*a* and ends 68*b* and 70*b*, respectively. As those skilled in the art will appreciate, the flanges 64 and 66 can be made of any geometric shape, such as but not limited to circular, triangular, square, hexagonal, octagonal, and polygonal.

In one embodiment, the flanges 64 and 66 are octagonal, as shown in FIGS. 6 and 7 for ease in manufacturing, aerodynamics, and light weight geometry. The wing section 62 is cylindrical and/or is configured to help catch the air when projectile 18 is in flight, much in the same way that a wing of an airplane or glider works. The projectile 60 when struck horizontally can fly somewhat like a glider.

The kit of the present invention provides various methods of playing a paddle and projectile game, the first being illustrated in FIGS. 1 and 2. The method includes swinging a paddle 12 or 38 in a generally downwardly direction, striking a projectile 18 having at least one projection 20 extending outwardly therefrom, in proximity to the projection 20 such that the projectile 18 moves in a substantially upwardly direction sufficiently high enough in the air in order that it can be struck again, swinging the paddle 12 in a generally horizontal direction as illustrated in FIG. 2, and finally, restriking the projectile 18 in a substantially horizontal direction away therefrom. Preferably, the striking step includes striking the projection 20 of the projectile 18 in a downward direction, and optimally near, but avoiding the sides 26 of such projectile 18, for maximum efficiency. Also preferred, the restriking step includes hitting the projectile 18 squarely in the middle portion of the face 14 of the paddle 12, for maximum efficiency and distance if desired.

The above game may be called "Flit", which refers to flipping and hitting the projectile, and the rules of the game are as follows: Play of the game can be opened in any appropriate manner. An individual can play the game by himself or herself or with others.

(1) The order of play having been determined in any suitable manner, the players proceed, taking turns.

(2) Player #1 strikes the projectile 18 projection 20 with paddle 12 so as to drive the projectile generally upwardly sufficiently high enough in the air in order that player #1 can strike the projectile again.

(3) Immediately thereafter, player #1 swings the paddle in a generally horizontal direction, restriking the projectile 18 in a substantially horizontal direction away therefrom in the playing field.

(4) Player #1 then predicts how many jumps or steps it will take player #2 to get from home, or where player one has struck and restruck the projectile 18 to where the projectile presently lies in the playing field.

(5) If player #2 accepts the challenge, he or she has the opportunity to attempt to make it from home to where the projectile 18 lies in the playing field in the number of jumps or steps player one predicted it would take. If player #2 achieves his goal of making it in the predicted number of steps or less, he is awarded the predicted number of points. If, on the other hand, player #2 declines to accept the challenge or does not make it in the predicted number of steps, player #1 is awarded those points.

(6) Thereafter, player #2 goes to bat or is given the opportunity to do what player #1 has just done, striking and restriking the projectile 18, followed by predicting and challenging player #1, as described in items (1)–(5) above.

(7) The game continues by alternating turns up to a fixed number of points or turns or a certain duration of time.

Another embodiment includes a game called "Popcorn". An individual can play this game by himself or herself or with others. In one embodiment, the rules are as follows:

(1) The order of play can be determined in any suitable manner. The players proceed taking turns.

(2) Player #1 strikes a plurality of projectiles 18 in a downwardly direction in rapid succession.

(3) Player #2 attempts to catch as many projectiles 18 as possible while they are in flight, and is given a point for each projectile caught. Player #1 can pop up the projectile 18 with a greater vertical component by hitting the projectile 18 downwardly at the end portion 40, or can opt to give it a more horizontal trajectory by utilizing middle portion 40, as described more fully above with respect to the construction of the paddle 38 of FIG. 4.

(4) Player #2 is given an opportunity to go to bat, and player #1 attempts to catch as many projectiles as possible while in flight, as described in steps (2) and (3).

(5) The game continues by alternating turns for a certain number of turns, until one of the players reaches a certain number of points or time. The player with the most points at the end of play wins. In one embodiment, steps (2), (3) and (4) can occur concurrently.

The third embodiment is called "Cannonball". An individual can play this game by himself or herself or with others. In one embodiment, the rules are as follows:

(1) The order of play can be determined in any suitable manner. The players proceed taking turns.

(2) Player #1 is given an opportunity to hit a plurality of projectiles 18 in a downward fashion, in the generally middle portion 40 of the paddle 38 illustrated in FIG. 4, in an attempt to deflect his projectiles 18 in a generally horizontal direction toward player #2's figurines or targets, one of which is shown in phantom in FIG. 1 and identified by reference numeral 50, trying to knock them down. Points are awarded for each figurine that is knocked down.

(3) Player #2 hits a plurality of projectiles 18 in a downward direction, in an attempt to deflect his projectiles in a generally horizontal direction toward player #1's figurines, trying to knock them down. In one embodiment, steps (2) and (3) can occur concurrently.

(4) The game continues by alternating turns for up to a certain number of turns or points. The player with the most points wins. This game can be played individually or competitively.

Although only two embodiments of a projectile have been shown and described, it is to be understood that various modifications and substitutions, as well as rearrangements and combinations of the preceding embodiments, can be made by those skilled in the art without departing from the teaching of the invention.

I claim:

1. A paddle and projectile kit, comprising in combination:

a paddle having a longitudinal axis and including a middle portion with a front face and a back face and handle means for holding said paddle; and a projectile having a longitudinal axis, a generally rectangular cross-section in the direction of the longitudinal axis and at least one generally flat end surface transversing the longitudinal axis and including at least one rod like, non-tapered projection extending generally perpendicularly outwardly form a middle portion of said at least one generally flat end surface sufficiently enough to provide a long enough target for the paddle to strike easily while not extending too far perpendicularly outwardly to interfere with a desired pop up action of the projectile when it is hit with the paddle and extending a distance which is less the lateral or transverse extent of said cross-section of said projectile.

2. The kit of claim 1, further comprising a substantially planar home base.

3. The kit of claim 1, wherein said front face is substantially elongated and substantially flat.

4. The kit of claim 1, wherein said projectile includes at least six substantially flat sides.

5. The kit of claim 1, wherein at least a portion of said paddle or said projectile is surrounded by a layer of soft material.

6. The kit of claim 1, wherein said projectile is hollow.

7. The kit of claim 1, wherein said paddle and projectile are made form at least one member of the group consisting of plastic, wood, or aluminum.

8. The kit of claim 1, wherein said at least one rod like projection is a generally cylindrical projection.

9. A paddle and projectile kit, comprising in combination:

a paddle having a longitudinal axis and including a middle portion with a front face and a back face and handle means for holding said paddle;

and a projectile having a longitudinal axis, and at least one generally flat end surface transversing the longitudinal axis and including at lest one rod like projection extending generally perpendicularly outwardly form a middle portion of said at least one generally flat end surface; said paddle being elongate, said front face and said back face each extending across said paddle between a wide edge and a narrow edge, said front face and said back face both being inclined or tapered form said wide edge completely across said middle portion toward each the and to said narrow edge, and said middle portion of said paddle is sufficiently wide transversely of said longitudinal axis so that said projectile is deflected horizontally away form said paddle as it bumps into one of said faces of said paddle when said rod like projection si first hit with said paddle at a certain point along the length of said rod like projection.

10. A paddle and projectile kit, comprising in combination:

a paddle having a longitudinal axis and including a middle portion with a front face and a back face and handle means for holding said paddle;

and a projectile having a longitudinal axis, and at least one generally flat end surface traversing the longitudinal axis and including at least one rod like projection extending generally perpendicularly outwardly form a middle portion of said at least one generally flat end surface; said paddle including an end portion opposite the handle, said end portion having at its outer end a spacer member and said paddle having, adjacent said spacer member, at least one side edge which is spaced inward of said spacer member so that said spacer member has an edge which extends outward of said at least one side edge.

11. A paddle and projectile kit, comprising in combination:

a paddle having a longitudinal axis and including a middle portion with a front face and a back face and handle means for holding said paddle;

and a projectile having a longitudinal axis, and at least one generally flat end surface traversing the longitudinal axis and including at least one rod like projection extending generally perpendicularly outwardly form a middle portion of said at least one generally flat end surface; said projectile including space apart flanges and an intermediate body section extending between an attached to said flanges, the outwardly facing surface of each flange defining one of said end surfaces and each end surface having a rod like projection extending outwardly therefrom.

12. The kit of claim 11, wherein each flange has a shape selected from the shapes consisting of generally triangular, generally square, generally circular, generally hexagonal, generally octagonal or generally polygonal.

13. The kit of claim 1, wherein said intermediate body section is a wing section.

* * * * *

UNITED STATES PATENT AND TRADEMARK OFFICE

CERTIFICATE OF CORRECTION

PATENT NO. : 5,236,195

DATED : August 17, 1993

INVENTOR(S) : Richard M. Rovnyak, Sr.

It is certified that error appears in the above-indentified patent and that said Letters Patent is hereby corrected as shown below:

Column 2, line 18 "projectile, with a second projectile;" should be —projectile;—.

Column 5, line 20 "ween playing" should be —when playing--.

Column 6, line 11 "one" should be --#1--.

Column 6, line 16 "one" should be --#1--.

Column 7, line 30 "form" should be --from--.

Column 7, line 51 "form" should be —from--.

Column 7, line 61 "transversing" should be --traversing—.

Column 8, line 1 "lest" should be --least--.

Column 8, line 3 "form" should be --from--.

Column 8, line 8 "form" should be --from--.

Column 8, line 10 "the" should be --other--.

Column 8, line 13, "form" should be --from--.

Column 8, line 15 "si first" should be --is first--.

Column 8, line 28 "form" should be --from--.

UNITED STATES PATENT AND TRADEMARK OFFICE

CERTIFICATE OF CORRECTION

PATENT NO. : 5,236,195

DATED : August 17, 1993

INVENTOR(S) : Richard M. Rovnyak, Sr.

It is certified that error appears in the above-indentified patent and that said Letters Patent is hereby corrected as shown below:

Column 8, line 46, "form" should be --from--.

Signed and Sealed this

Twenty-eighth Day of June, 1994

Bruce Lehman

*Attest:*

BRUCE LEHMAN

*Attesting Officer*

*Commissioner of Patents and Trademarks*